United States Patent [19]

Bastiansen et al.

[11] Patent Number: 4,580,373

[45] Date of Patent: Apr. 8, 1986

[54] BUILDING ELEMENT AND ROOF STRUCTURE COMPRISING A PLURALITY OF SUCH ELEMENTS

[75] Inventors: Kaj Bastiansen; Christian Bjørn, both of Copenhagen; Sven Harder, Albertslund; Keld H. Nielsen, Birkerød; Jørn Sorensen, Gistrup; Lars Thousig, Herlev, all of Denmark

[73] Assignee: Aktieselskabet Jens Villadsens Fabriker, Herlev, Denmark

[21] Appl. No.: 655,431

[22] Filed: Sep. 28, 1984

[30] Foreign Application Priority Data

Sep. 30, 1983 [DK] Denmark ..... 4531/83

[51] Int. Cl.[4] ..... E04B 7/00; E04C 1/30

[52] U.S. Cl. ..... 52/94; 52/309.1; 52/538; 52/588

[58] Field of Search ..... 52/94, 521, 522, 394, 52/536, 588, 538, 309.1

[56] References Cited

U.S. PATENT DOCUMENTS

| | | | |
|---|---|---|---|
| 2,159,136 | 5/1939 | Delk | 52/537 X |
| 2,887,192 | 5/1959 | Schaub et al. | 52/478 X |
| 3,886,705 | 6/1975 | Cornland | 52/536 X |
| 4,128,984 | 12/1978 | Charbonneau et al. | 52/478 X |
| 4,441,291 | 4/1984 | Sokoler et al. | 52/588 X |
| 4,509,306 | 4/1985 | Sokoler et al. | 52/302 |

FOREIGN PATENT DOCUMENTS

| | | | |
|---|---|---|---|
| 253451 | 7/1964 | Australia | 52/478 |
| 2111157 | 11/1972 | Fed. Rep. of Germany | 52/586 |
| 1511189 | 5/1978 | United Kingdom | 52/309.1 |

*Primary Examiner*—Alfred C. Perham
*Assistant Examiner*—Jean M. LaKemper
*Attorney, Agent, or Firm*—Watson, Cole, Grindle & Watson

[57] ABSTRACT

A hollow building element of a plastics material comprises an upper wall, a lower wall, a pair of opposite side walls interconnecting the lateral edges of the upper and lower walls, a joining member in the form of a cylindrical, slotted, downwardly open flange provided at the upper edges of each side wall, the lower end of a side wall being integrally connected to an anchoring element for anchoring the building element to a support and the lower end of the opposite side wall being integrally connected to a guide member adapted to engage the anchoring member of an adjacent building element so as to maintain the lower ends of two adjacent side walls in spaced relationship and so as to form a tight connection between such elements.

19 Claims, 3 Drawing Figures

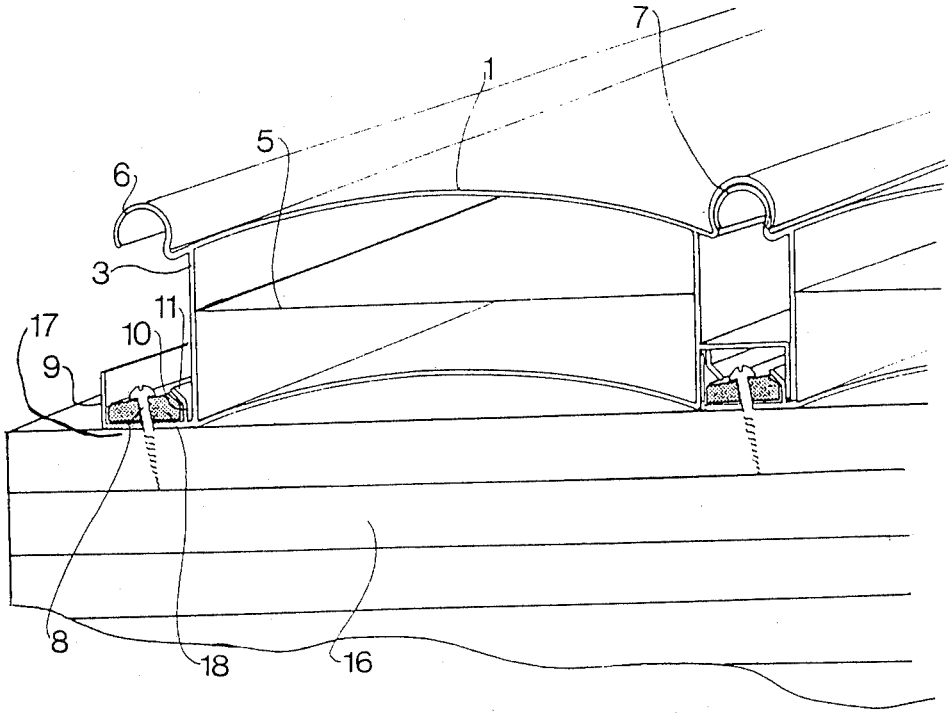
FIG.2
FIG.3
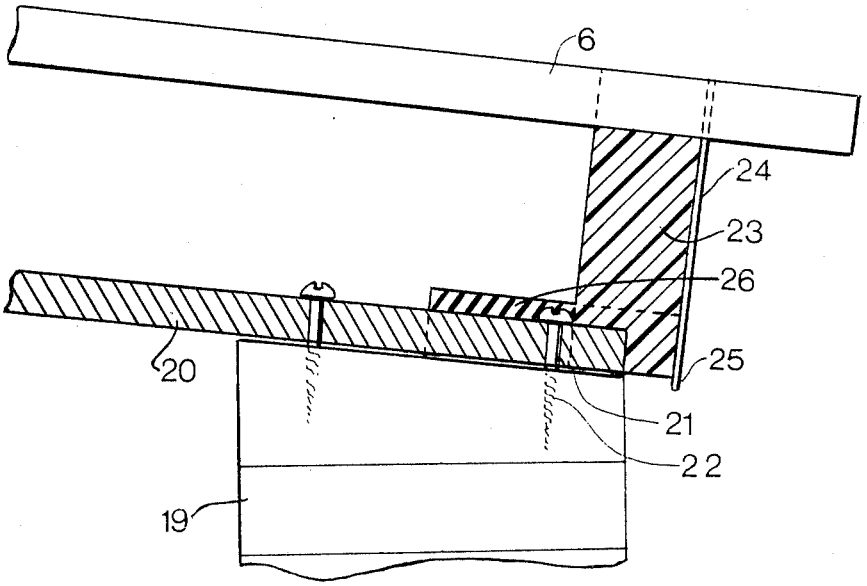

BUILDING ELEMENT AND ROOF STRUCTURE COMPRISING A PLURALITY OF SUCH ELEMENTS

BACKGROUND OF THE INVENTION

This invention relates to a hollow building element of a plastics material comprising an upper wall, a lower wall, a pair of opposite side walls interconnecting the lateral edges of the upper and lower walls and joining members provided at the upper ends of the side walls for joining adjacent identical building elements to form a continuous structure.

Building elements of this type are disclosed in British patent specification No. 1.511.189. These building elements comprise joining members provided at both the upper and lower ends of each side wall. These prior art building elements are joined so as to form a continuous structure, such as a roof structure, by hooking the joining member provided at the upper end of the side wall of a first building element onto the joining member provided at the upper end of the side wall of a second element and by placing the joining member at the lower end of the side wall of the former building element in such a position that it is partially surrounded by the joining member at the lower end of the side wall of the second building member. Subsequently, a locking member is inserted in the space between the adjacent side walls so as to keep the pairs of joining members in intimate contact. Roof structures composed of such building elements are ordinarily anchored to a beam construction or a similar support by means of rods which are inserted into holes in the side walls and which extend perpendicular to the longitudinal axis of the building elements. These rods are inserted in annular anchoring elements which by means of screws are connected to fixing means attached to the beam structure.

The manner in which these building elements are anchored to the support necessitates that a careful calculation of the location of the fixing means has to be made before a roof structure is built in order to ensure that the above mentioned screw connections can be established when the building elements have been correctly placed on the support.

SUMMARY OF THE INVENTION

The object of the invention is to provide a building element of the type defined in the introductory part of the specification and which is capable of being easily and safely anchored to a support when it has been joined to a similar element.

This object and other objects which will appear from the following explanation are achieved with the building element of the invention which is characterized in that the joining members provided at the upper ends of the side walls consist of cylindrical, slotted, downwardly open flanges of such dimensions that a flange of a first element can be snap locked to a flange of a second identical element, that the lower end of one side wall is integrally connected to an anchoring member comprising a bottom plate extending essentially perpendicularly out from said side wall and that the lower end of the opposite side wall is integrally connected to a guide member which is adapted to engage the anchoring member of an adjacent identical building element so as to maintain the lower ends of two adjacent side walls in spaced relationship and so as to form a tight connection between such elements.

When such a building element is placed on a support, e.g. to provide a roof structure, the anchoring element is preferably attached to the support by means of screws, e.g. by forcing such screws through the bottom plate of the anchoring member and into the support which ordinarily is made from wood. When a second building element is to be joined with the one already anchored to the support, the cylindrical, slotted, downwardly open flange of the former element is snap locked to the flange of the latter element, and at the same time the guide member of the former element is brought into engagement with the anchoring member of the element already anchored to the support. The joining operation may simply be effected by placing the cylindrical, slotted, downwardly open flange of the second building element on top of the flange of the first element and by pressing the former flange towards the support until a snap lock has been established. When the joining operation has been completed, the second building element is anchored to the support by means of screws as described above. These operations are then repeated in connection with each additional element which is to form part of the desired roof structure.

The bottom plate of the anchoring member preferably comprises an upright flange at its free edge so as to provide a restricted zone between the side wall and the upright flange. Such a zone facilitates the insertion of pressure distributing elements for the screws used for the attachment of the building element to the support. These pressure distributing elements preferably comprise holes in which the screws may be inserted. The holes in these elements may also serve to facilitate the drilling of holes in the bottom plate of the anchoring member.

In order to allow tools to be used when attaching the anchoring member to the support, the holes provided in the pressure distributing elements preferably have an axis which forms an acute angle with the adjacent side wall, and the pressure distributing elements are preferably wedge-shaped. These elements may be in the form of small units, such as discs or blocks, or may have a considerable length.

When it is desired to maintain the pressure distributing elements in a position close to the upright flange at the free end of the bottom plate, the building element preferably comprises a further upright flange provided in proximity of the side wall and having an upper inclined part extending outwardly from the side wall. Such an additional flange may also serve to make the construction more tight.

The guide member at the lower end of the opposite side wall preferably comprises an integral, essentially plane flange which is essentially perpendicular to the side wall and which comprises at its free end a downwardly extending flange. When a building element of this type is joined with an element having an anchoring member comprising a flange provided in close proximity of the side wall and having an outwardly extending inclined flange, the latter flange may act as a guide for the downwardly extending flange of the guide member of the adjacent element.

The guide member may further comprise a downwardly extending flange extending downwardly from the flange extending outwardly from the side wall and located in close proximity of the side wall. This downwardly extending flange may comprise an inclined flange extending outwardly relative to the side wall. These additional flanges serve to guide the upright flange at the free edge of the bottom plate of the anchoring member into its proper position parallel to the side wall of the adjacent element.

When making large planar or curved roof structures from the elements of the invention, it may be preferable to utilize pressure distributing elements in the form of rods extending from one end of an element to the other and comprising holes for attaching the rods to the support said holes being provided at the ends of the rods. Thus, these rods also serve to absorb the tensions which may be created as a result of high suction forces. If the calculated suction forces are particularly high, it may be desirable to use rods which are longer than the building elements and which at their free ends are connected to structural elements supporting the roof structure via fastening means, such as angle plates which are well known per se.

The rods extending from one end of the building elements to the other may be attached in a prestressed condition. The rods are preferably made from metal, such as aluminum, and may be prepared by extrusion.

In order to prevent undesired draught in the space between the upper wall, the lower wall and the side walls, sealing elements may be inserted in the building elements at their free ends. Such sealing elements may be made from foamed resin and the outwardly facing ends of these elements may be attached to a plate member extending down below the lower wall so as to form a lug. In case the lower wall is curved seen in a section perpendicular to the longitudinal axis of the elements, free zones are formed between the lower walls of the building elements and the support. These zones may be blocked by means of compressible sealing strips which are compressed in the area below the anchoring members. Such sealing strips may consist of neoprene rubber.

BRIEF DESCRIPTION OF THE DRAWINGS

FIG. 2 is a perspective view of a roof structure comprising building elements of the invention, and FIG. 3 is a schematic cross-sectional view in the longitudinal direction of the building element of the zone in which such an element is anchored to a support.

DESCRIPTION OF THE PREFERRED EMBODIMENTS

Figure 1:
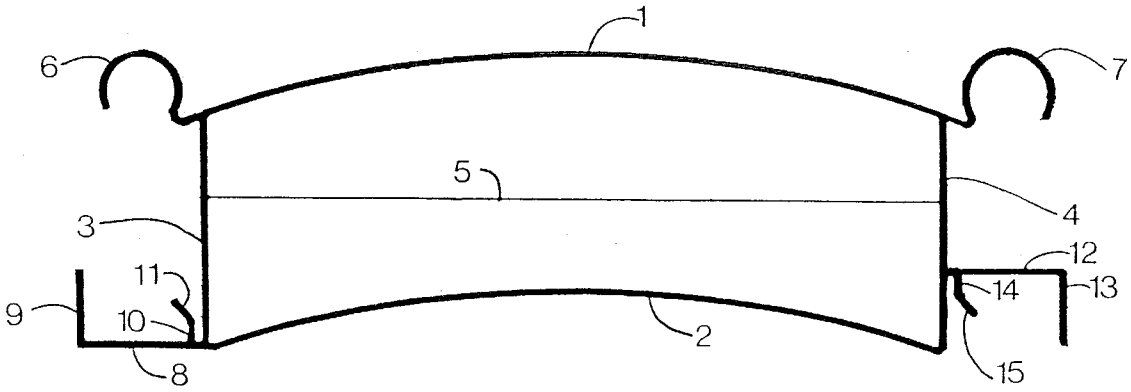
FIG. 1 is a cross-sectional view of a preferred embodiment of the building element of the invention.

The building element illustrated in FIG. 1 comprises an upper wall 1, a lower wall 2 and a pair of opposite side walls 3 and 4. The upper wall 1 and the lower wall 2 are curved and a thin partition wall 5 is provided between the walls 1 and 2. The building element illustrated comprises cylindrical, slotted flanges 6,7 provided at the upper ends of the side walls and extending over the full length of the building element. The outer diameter of the flange 6 is smaller than that of the flange 7, and the flange 7 may be snap locked over a flange 6 of another building element.

An anchoring member comprising a plane bottom plate 8 and two upright flanges 9,10, of which the flange 10 comprises an upper outwardly inclined part 11, is provided at the lower end of the side wall 3.

A guide member comprising a plate member 12 having two downwardly extending flanges 13 and 14, of which the flange 14 comprises an inclined outwardly extending part 15, is provided at the lower end of the side wall 4.

The building elements shown in FIG. 2 are identical to the building element shown in FIG. 1, and the same reference numerals have been used to designate the same parts.

FIG. 2 illustrates the manner in which two building elements are anchored to a beam 16. Screws 17 are inserted in holes in a wedge-shaped pressure distributing element 18. The holes in the element 18 are drilled in such a manner that the axes of the holes are inclined relative to the side wall in order to provide the necessary space for the use of a screw driver in spite of the fact that the flange 6 extends into the zone above the bottom plate 8. As will appear from FIG. 2, the pressure distributing element is of such a shape that it fits into the zone formed between the bottom plate 8, the upright flanges 9,10 and the upper inclined part 11 of the flange 10.

FIG. 3 illustrates the manner in which a building element of the invention is attached to a beam 19 by means of a pressure distributing element in the form of a rod 20 extending over the full length of the building element. The zone of the rod 20 which is located above the beam 19 comprises holes 21, and screws 22 are inserted in the holes 21. The element illustrated comprises an upper wall which together with the cylindrical flanges, of which only one, 6, is shown in FIG. 3, are longer than the side walls and the lower wall. The space between the upper wall and the lower wall is closed by an insulating element 23 attached to a plate 24 having a lug 25.

A compressible sealing strip 26 is provided in the zone between the lower wall of the building element and the beam 19 and this strip 26 is fully compressed in the zone located below the rod 20.

We claim:

1. A hollow building element of a plastic material comprising an upper wall, a lower wall, said upper and lower walls each having two opposite lateral edges, a pair of opposite side walls interconnecting the lateral edges of the upper and lower walls, and joining members provided at the upper ends of the side walls and joining adjacent identical building elements to form a continuous structure, wherein the joining members provided at the upper ends of the side walls comprise cylindrical, slotted, downwardly open flanges of such dimensions that a flange of a first element can be snap locked to a flange of a second identical element, and wherein the lower end of one side wall is integrally connected to an anchoring member comprising a bottom plate extending essentially perpendicularly out from said one side wall, and the lower end of the opposite side wall is integrally connected to a guide member which is adapted to engage the anchoring member of an adjacent identical building element so as to maintain the lower ends of two adjacent side walls in spaced relationship and so as to form a tight connection between such elements, the guide member comprising an essentially plane plate extending outwardly from the opposite side wall and having a downwardly extending flange at its free end.

2. A building element as in claim 1, wherein the free end of the bottom plate of the anchoring member has an upright flange.

3. A building element as in claim 2, wherein the bottom plate comprises a further upright flange provided in close proximity of the side wall and having an inclined outwardly extending upper portion.

4. A building element as in claim 1, wherein the guide member comprises a further flange extending downwardly from the plane plate in close proximity of the opposite side wall and comprising an inclined outwardly extending lower portion.

5. A roof structure comprising a plurality of building elements of a plastics material, each building element comprising an upper wall, a lower wall, said upper and lower walls each having two opposite lateral edges, a pair of opposite side walls interconnecting the lateral edges of the upper and lower walls, and joining members provided at the upper ends of the side walls and joining adjacent identical building elements to form a continuous structure, said roof structure being anchored to a support, wherein the joining members provided at the upper ends of the side walls comprise cylindrical, slotted, downwardly open flanges of such dimensions that a flange of a first element can be snap locked to flange of a second identical element, and wherein the lower end of one side wall is integrally connected to an anchoring member comprising a bottom plate extending essentially perpendicularly out from said one side wall, and the lower end of the opposite side wall is integrally connected to a guide member which is adapted to engage the anchoring member of an adjacent identical building element so as to maintain the lower ends of two adjacent side walls in spaced relationship, the guide member comprising an essentially plane plate extending outwardly from the opposite side wall and having a downwardly extending flange at its free end further comprising fixing means extending through the bottom plates of the anchoring members and into the support.

6. A roof structure as in claim 5, wherein pressure distributing elements are provided on the top surfaces of the bottom plates of the anchoring members, and pressure distributing elements are pressed against the bottom plates by means of screws inserted in the support.

7. A roof structure as in claim 6, wherein the pressure distributing elements extend over the full length of the building elements are are attached to the support at the ends of said pressure distributing elements.

8. A roof structure as in claim 6, wherein the pressure distributing elements are wedge-shaped.

9. A roof structure as in claim 8, wherein the wedge-shaped pressure distributing elements comprise holes having axes forming an acute angle with the adjacent side wall.

10. A roof structure as in claim 5, further comprising sealing elements inserted in the hollow elements at their free ends.

11. A roof structure as in claim 5, wherein a compressible sealing strip is provided in the zone between the lower wall of each building element and the support.

12. A hollow building element of a plastics material comprising an upper wall, a lower wall, said upper and lower walls each having two opposite lateral edges, a pair of opposite side walls interconnecting the lateral edges of the upper and lower walls, and joining members provided at the upper ends of the side walls and joining adjacent identical building elements to form a continuous structure, wherein the joining members provided at the upper ends of the side walls comprise cylindrical, slotted, downwardly open flanges of such dimensions that a flange of a first element can be snap locked to a flange of a second identical element, and wherein the lower end of one side wall is integrally connected to an anchoring member comprising a bottom plate extending essentially perpendicularly out from said one side wall, the free end of the bottom plate having an upright flange and having a further upright flange in close proximity of said one side wall, said further flange having an inclined outwardly extending outer portion, and the lower end of the opposite side wall is integrally connected to a guide member which is adapted to engage the anchoring member of an adjacent identical building element so as to maintain the lower ends of two adjacent side walls in spaced relationship and so as to form a tight connection between such elements.

13. A roof structure comprising a plurality of building elements of a plastics material, each building element comprising an upper wall, a lower wall, said upper and lower walls each having two opposite lateral edges, a pair of opposite side walls interconnecting the lateral edges of the upper and lower walls, and joining members provided at the upper ends of the side walls and joining adjacent identical building elements to form a continuous structure, said roof structure being anchored to a support, wherein the joining members provided at the upper ends of the side walls comprise cylindrical, slotted, downwardly open flanges of such dimensions that a flange of a first element can be snap locked to a flange of a second identical element, and wherein the lower end of one side wall is integrally connected to an anchoring member comprising a bottom plate extending essentially perpendicularly out from said one side wall, the free end of the bottom plate having an upright flange and having a further upright flange in close proximity of said one side wall, said further flange having an inclined outwardly extending outer portion, and the lower end of the opposite side wall is integrally connected to a guide member which is adapted to engage the anchoring member of an adjacent identical building element so as to maintain the lower ends of two adjacent side walls in spaced relationship, and further comprising fixing means extending through the bottom plates of the anchoring members and into the support.

14. A roof structure as in claim 13, wherein pressure distributing elements are provided on the top surfaces of the bottom plates of the anchoring members and that the pressure distributing elements are pressed against the bottom plates by means of screws inserted in the support.

15. A roof structure as in claim 14, wherein the pressure distributing elements extend over the full length of the building elements and are attached to the support at the ends of said pressure distributing elements.

16. A roof structure as in claim 14, wherein the pressure distributing elements are wedge-shaped.

17. A roof structure as in claim 16, wherein the wedge-shaped pressure distributing elements comprise holes having axes forming an acute angle with the adjacent side wall.

18. A roof structure as in claim 13, further comprising sealing elements inserted in the hollow elements at their free ends.

19. A roof structure as in claim 13, wherein a compressible sealing strip is provided in the zone between the lower wall of each building element and the support.

* * * * *